United States Patent [19]

Jarrett

[11] Patent Number: 4,601,488

[45] Date of Patent: Jul. 22, 1986

[54] SAILING SKI FOR USE ON SNOW AND ICE

[75] Inventor: Mark Jarrett, Mount Clemens, Mich.

[73] Assignee: Evans Marine, Inc., Detroit, Mich.

[21] Appl. No.: 678,653

[22] Filed: Dec. 6, 1984

[51] Int. Cl.[4] ..... A63C 11/00

[52] U.S. Cl. ..... 280/810; 114/43; 280/608

[58] Field of Search ..... 280/810, 606, 607, 608, 280/609, 610, 12 H; 114/43

[56] References Cited

U.S. PATENT DOCUMENTS

| | | | |
|---|---|---|---|
| 3,827,096 | 8/1974 | Brownson | 280/609 X |
| 3,940,157 | 2/1976 | Sakuma | 280/610 |
| 3,982,766 | 9/1976 | Budge | 280/810 X |
| 4,083,577 | 4/1978 | Ford | 280/609 |
| 4,204,694 | 5/1980 | Freeman | 280/810 |

FOREIGN PATENT DOCUMENTS

| | | | |
|---|---|---|---|
| 2607378 | 8/1977 | Fed. Rep. of Germany | 280/810 |
| 3040522 | 5/1982 | Fed. Rep. of Germany | 280/810 |

OTHER PUBLICATIONS

*Winter surfer,* Swedish Wind, Stockholm.
*Windskier,* Windskier Corp., Nevada.
*Snowsailer,* Snowsailing International Inc., Michigan.

*Primary Examiner*—John A. Pekar
*Assistant Examiner*—Michael Mar
*Attorney, Agent, or Firm*—Barnes, Kisselle, Raisch, Choate, Whittemore & Hulbert

[57] ABSTRACT

A sailing ski for use on snow and ice comprising an elongated body having substantially flat upper and lower surfaces, the lower surface having an upwardly extending camber, a universal mast mount for mounting a sail positioned toward the forward end of the elongated body, longitudinally spaced foot straps positioned rearwardly of the universal mast mount and overlying the camber area, and longitudinally spaced runners along the edges of the ski rearwardly of the foot straps and having a portion thereof projecting at least partly below the lower surface of the ski with the runners being in transversely spaced parallel relation.

7 Claims, 7 Drawing Figures

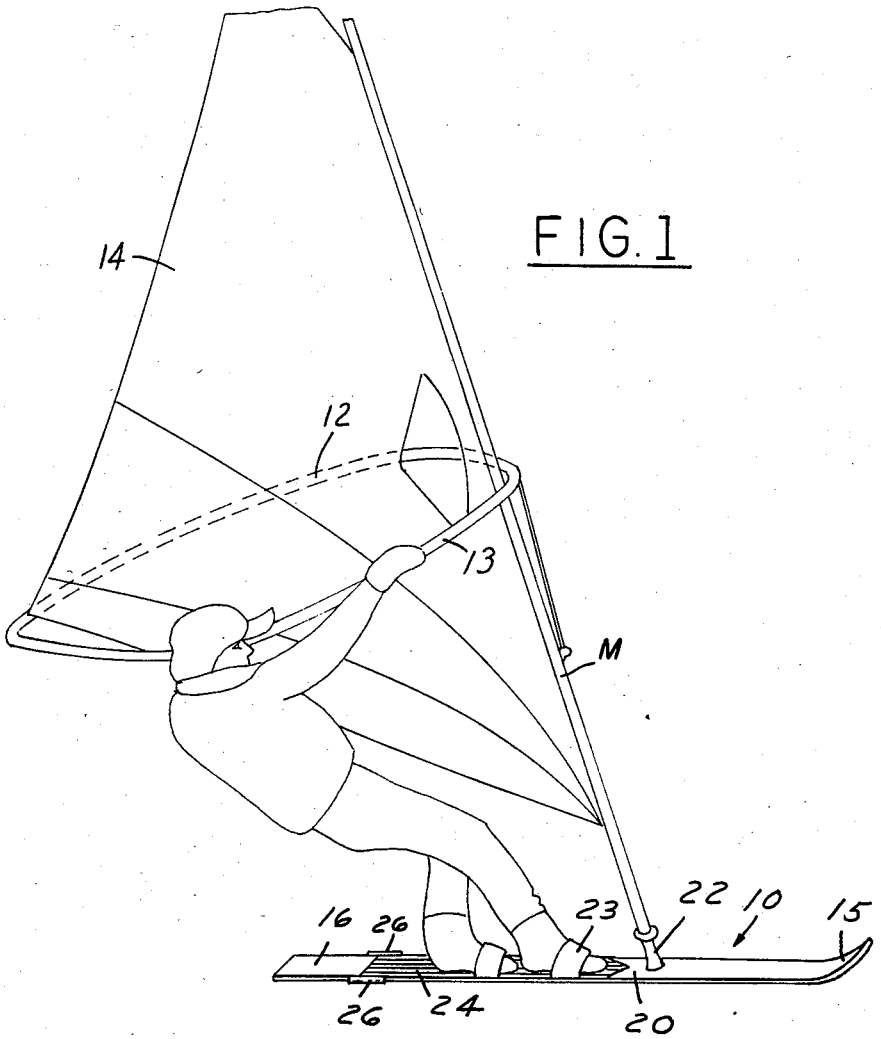
FIG. 1
FIG. 6
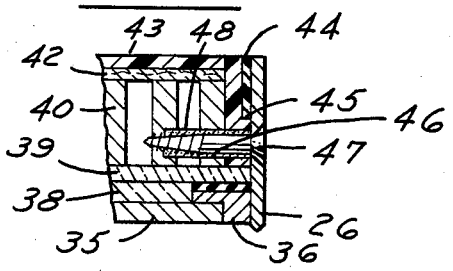
FIG. 7
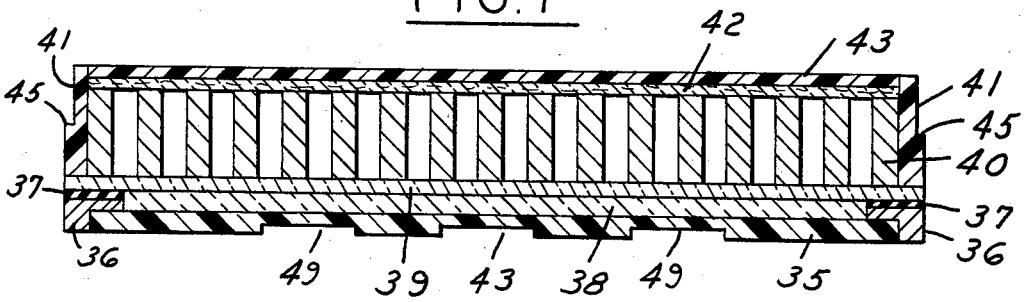

SAILING SKI FOR USE ON SNOW AND ICE

This invention relates to sailing devices for use on snow and ice which utilize a movable mast supporting a sail.

BACKGROUND AND SUMMARY OF THE INVENTION

In summer recreational activities, it has become common to use what is known as a sail board wherein an elongated body similar to a surfboard is provided with a universally mounted mast that supports a sail and the mast is manipulated by booms which extend transversely from the mast on each side of the sail.

Various efforts have been made to provide similar sails on devices for moving along snow and ice. For example, a device is being made which comprises a sail board on which the sail mast is mounted which has two conventional skis attached to the underside thereof. However, among the disadvantages of such a device are that it requires two skis, is difficult to control, and will not sail on ice. Such a device is sold under the trademark "WINDSKIER" by Windskier International Corporation of Reno, Nev.

Another device comprises an aluminum connecting rod which attaches to skis or skates worn on the feet to which the sail mast is attached. Such a device has disadvantages in that the skis or skates must be worn, it is difficult to sail in proximity to the mast with respect to the sailor, and it is likely to be dangerous. Such a device is sold under the trademark "WINTERSURFER" by Wintersurfer Company of Sweden.

Another device comprises a board similar to a surfboard on which the mast is mounted, the board having a concave bottom. Such a device has disadvantages in that it does not have sufficient lateral resistance to sail well or steer well, the large surface creates substantial drag, and it may be dangerous. Such a device is sold under the trademark "SNOW SAILER" by Snow Sailing International, Inc., of Farmington Hills, Mich.

Another device shown in West German patent DT No. 197805 comprises an oval surf board with a sail controlled by ropes. Such a device has disadvantages in that it has substantial drag, minimal ability to create lateral resistance, and is not provided with any means of locking the feet in cases of use through slippery snow. Further, it does not have a universal joint and provides too much surface tension with respect to the snow.

The United States patent to Freeman U.S. Pat. No. 4,204,694 discloses a sail structure which consists of a ski that is alleged to work on ice or snow comprising a mast, spar and boom for holding a triangular sail which is held in rigid position on the ski. Such a system has substantial drag, substantially no lateral resistance, does not have a universally mounted conventional sail board sail and is likely to be unstable on ice and includes no mechanism for holding the skier to the ski. In another form shown in U.S. Pat. No. 4,204,694, the mast is attached to one of the ice skates. In another form, an outrigger style cross board is provided with runners.

Among the objectives of the present invention are to provide a sailing ski for use on snow and ice which obviates the aforementioned difficulties; which simulates the function of a sail board so that persons familiar with use of a sail board can readily adapt to use the sailing ski on snow and ice; which can be readily steered; which has substantially reduced drag; which will effectively hold the user even when used on ice and which can be controlled and moved readily.

DESCRIPTION OF THE DRAWINGS

FIG. 1 is a perspective view of the sailing ski embodying the invention.

FIG. 6 is a fragmentary sectional view on an enlarged scale taken along the line 6—6 in FIG. 3.

FIG. 7 is a transverse cross section taken along the line 7—7 in FIG. 3 showing the construction of the ski.

DESCRIPTION

Referring to FIG. 1, the sailing ski embodying the invention comprises a ski 10 which resembles a conventional snow ski, except as herein described, and includes a universal mount 11 for the mast M and transverse booms 12, 13 which support a sail 14 in a conventional manner as utilized in sail boards.

Figure 2:
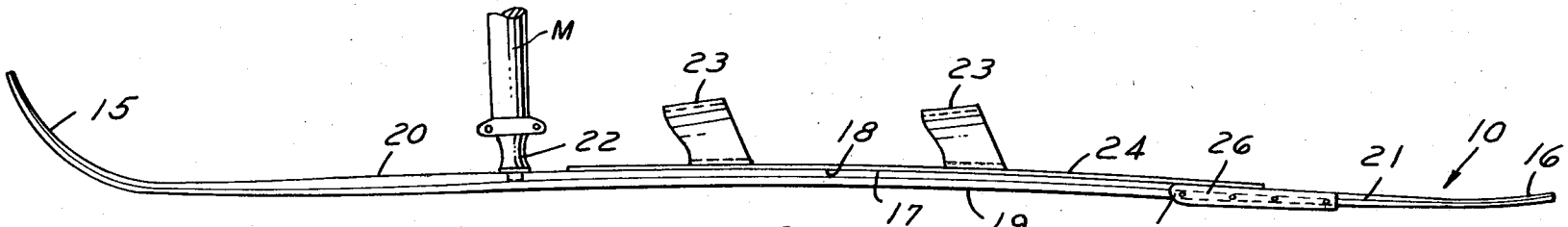
FIG. 2 is a side elevational view of the sailing ski with the mast and sail removed.
Figure 3:
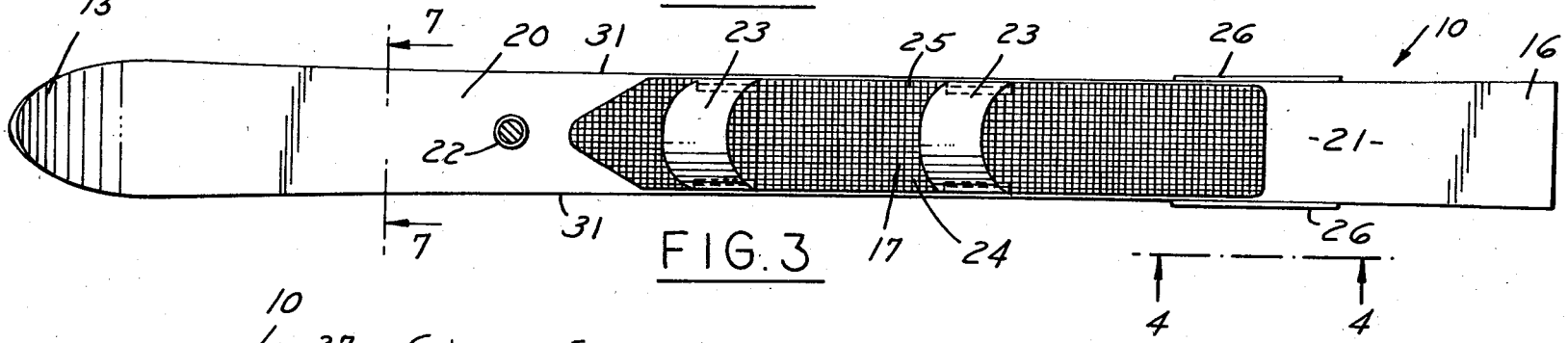
FIG. 3 is a plan view of the sailing ski with the universal mast mount removed.
Figure 4:
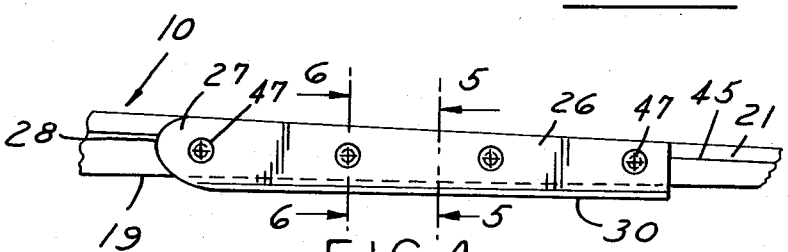
FIG. 4 is a fragmentary enlarged view of a portion of the ski taken along the line 4—4 in FIG. 3.

Referring to FIGS. 2 and 3, the ski 10 comprises an elongated body which has a forward ski tip 15 extending upwardly and forwardly and an end 16 extending rearwardly and upwardly. The center portion 17 increases in thickness between the tips and the upper surface 18 is upwardly concave and the lower surface 19 is upwardly convex providing a space that defines a camber intermediate the portion 20 adjacent the tip 15 and the portion 21 adjacent the end 16.

A universal mast mount 22 is removably attached to the upper surface at a point rearwardly from point 20 toward the forward end of the ski and foot straps 23 made of elastic material are provided at longitudinally spaced points substantially at the center of the center portion 17. A non-skid mat 24 is provided at the center portion of the upper surface 18 and extends from a point just forwardly of the first strap to a point rearwardly of the second strap. The upper surface of the mat 24 preferably has ribs 25 in the form of a triangular cross section.

Figure 5:
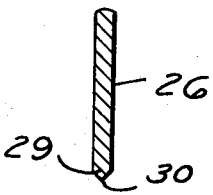
FIG. 5 is an end view taken along the line 5—5 in FIG. 4.

At a point toward the rear of the camber 19 adjacent the area 21 that normally engages the floor when the ski is on the ground, runners 26 are attached to the sides of the ski and each runner has a forward end 27 that has a flat surface 28 and a bottom edge 29 that is shaped to form a thin edge 30 extending longitudinally of the ski, preferably having an included angle of 45° as shown in FIG. 5. Bottom edge 30 is preferably concave upwardly from end to end.

The sides 31 of the ski extend inwardly toward the center of the body portion 17 and then outwardly such that the side surfaces are convexed inwardly.

The ski itself is formed in a laminated construction such as commonly used in skis and preferably includes metal side edges for use in cutting into snow and ice for turning in the manner of conventional snow skis and further includes a plastic bottom edge of polyethylene or the like.

In a typical construction as shown in FIG. 7, the lamination comprises a lower plastic layer 35, longitudinally extending metal side edges 36 and longitudinally extending rubber strips 37. A layer 38 of epoxy and glass fiber is provided over the plastic layer between the side edges 36 and a second layer 39 of epoxy and fiberglass overlies the layer 38 and the rubber strips 37. Transversely spaced laminated wood core elements 40 are provided transversely on the layer 39, plastic side edges 41 are provided along the side edges and an epoxy and fiberglass layer 42 and top plastic layer 43 complete the top of the laminated body.

When the runners 26 are provided as shown in FIG. 6, a plastic layer 44 is interposed between the plastic sides 41 and the runner 26 to fill the space above the notch or shoulder 45. A cavity 46 is provided for receiving the screws 47 and a colloidal silicon epoxy 48 bonds the screws in position resulting in a strong attachment of the runners to the body. Grooves 49 may be provided and extend substantially along the entire length of the ski as shown in FIG. 7.

In a typical sailing ski, the width of the sailing ski at the narrowest portion exceeds the width of the normal foot and may range between 4 and 8 inches at the tip or widest point and is preferably about 7½ inches. The length of the ski may range between 6 and 12 feet. The runners may range between 6 and 12 inches and the portions of the runners extending below the bottom surface of the ski may range between 1/16 and ½ inch, preferably about ⅜ inch. The runners 26 are located preferably adjacent the portion 21 and extend forwardly with the free edge entering the camber area. The universal mount is provided rearwardly of the area 20 and forwardly of the straps above the camber area.

When the sailing ski is placed on a flat surface without having the user thereon, the relative positions of the parts including the camber are as shown in FIG. 2. When the user steps on the skis, the camber portion flexes downwardly. As in the case of conventional skis, the camber permits the ski to have low drag, low surface tension while standing still or beginning to sail, and produces a low drag at higher speed. The edges of the ski cut into snow and ice in a manner similar to Alpine skiing so that the skis can be utilized to create an arc and turn in the direction in which the edge is directed into the snow or ice. The ski will flex transversely in the area of the camber but will not flex when subjected to torsion.

The skeg-like runners offer lateral resistance in very hard-packed or solid ice conditions when the metal edges, bottom and side cut of the ski do not offer sufficient lateral resistance.

The use of a single sailing ski constructed in the manner described permits the ski to be utilized in a manner similar to manipulation of a sailing board by movement of the sail so that the sail may be moved forward and aft relative to the ski using conventional sail board technology which allows the center of effort to be moved and aft of the lateral center of resistance and partially causes the apparatus to steer up into the wind or away from the wind.

I claim:

1. A sailing ski for use on snow and ice comprising:

a single elongated body in the form of a ski having substantially flat upper and lower surfaces and being wider than a conventional ski, a universal mast mount for mounting a sailing assembly positioned toward the forward end of the elongated body, said sailing assembly comprising a mast, transverse beams and a sail, said mast engaging said universal mast mount, longitudinally spaced foot straps positioned rearwardly of the universal mast mount, and a pair of longitudinally extending runners on the sides of the ski rearwardly of said foot straps, each runner having a lower edge projecting at least partly below the lower surface of the ski, each runner including a forward end that extends upwardly and forwardly and a bottom edge that extends rearwardly from the forward end, the forward end being flat in a transverse direction and the bottom edge tapered toward a centrally located free cutting edge symmetrical in cross section, said ski having a camber along its lower surface and a substantially flat plastic covering along its lower surface with a plurality of longitudinally extending grooves therein said ski having longitudinally spaced foot straps positioned rearwardly of the universal mast mount, said straps overlying the camber area, each runner having a rear portion attached to the rear end of the ski adjacent the end of the camber area and a forward portion extending forwardly of the ski into the camber area, the sides of the ski having an inwardly extending concave curve running the length of the ski.

2. The sailing ski set forth in claim 1 wherein said bottom edge is formed by surfaces defining an included angle of about 45°.

3. The sailing ski set forth in claim 1 wherein a resilient pad is provided beneath the foot straps and extend forwardly and rearwardly thereof.

4. The sailing ski set forth in claim 1 wherein the sides of the ski include metal edges extending longitudinally.

5. The sailing ski set forth in claim 1 wherein said runners are mounted by a plurality of screws extending into a plurality of cavities in the ski and an epoxy composition filling the cavities about the screws.

6. The sailing ski set forth in claim 1 wherein the width of said ski at the widest point is at least 4 inches.

7. The sailing skis set forth in claim 1 wherein said ski has a width at the widest point of about 7½ inches.

* * * * *